US010429772B2

(12) United States Patent
Kubota

(10) Patent No.: US 10,429,772 B2
(45) Date of Patent: Oct. 1, 2019

(54) IMAGE FORMING APPARATUS

(71) Applicant: CANON KABUSHIKI KAISHA, Tokyo (JP)

(72) Inventor: Hitoshi Kubota, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/909,807

(22) Filed: Mar. 1, 2018

(65) Prior Publication Data

US 2018/0253037 A1 Sep. 6, 2018

(30) Foreign Application Priority Data

Mar. 2, 2017 (JP) ..... 2017-039561

(51) Int. Cl.
*G03G 15/16* (2006.01)
*G03G 21/10* (2006.01)

(52) U.S. Cl.
CPC ..... *G03G 15/168* (2013.01); *G03G 15/161* (2013.01); *G03G 21/10* (2013.01); *G03G 2215/1661* (2013.01)

(58) Field of Classification Search
CPC ..... G03G 15/0189; G03G 15/161; G03G 15/1615; G03G 2215/1661
See application file for complete search history.

(56) References Cited

U.S. PATENT DOCUMENTS 9,164,433 B2 * 10/2015 Kudo ..... G03G 15/161

FOREIGN PATENT DOCUMENTS

JP 2004177935 A * 6/2004 ..... G03G 21/0029
JP 2010-20134 A 1/2010
JP 2014-178505 A 9/2014

* cited by examiner

*Primary Examiner* — Erika J Villaluna
(74) *Attorney, Agent, or Firm* — Canon U.S.A., Inc. I.P. Division

(57) ABSTRACT

A belt unit removably attached to an apparatus body includes a cleaning unit configured to clean a belt, and a sheet metal configured to hold a blade for cleaning the belt is fixed to the cleaning unit. The sheet metal is in contact with a supporting portion of the apparatus body, whereby vibrations of the sheet metal is reduced.

16 Claims, 13 Drawing Sheets

IMAGE FORMING APPARATUS

BACKGROUND OF THE INVENTION

Field of the Invention

The present disclosure relates to an electrophotographic image forming apparatus such as a printer, copying machine, facsimile, or multi-function peripheral.

Description of the Related Art

Electrophotographic image forming apparatuses using a so-called intermediate transfer method are known in which full-color toner images are formed on an endless intermediate transfer belt. The intermediate transfer belt is stretched by a plurality of tension rollers such that the intermediate transfer belt is freely rotatable. In this case, so-called "belt deviation", which is a situation in which the intermediate transfer belt (hereinafter, simply referred to as "belt") which is rotating is moved to one of the end sides of the rollers, can occur depending on the accuracy of outer diameters of the rollers, the accuracy of relative alignments between the rollers, etc. To correct "belt deviation" and locate the belt in a predetermined position in the width direction (the direction intersecting with the rotation direction of the belt), Japanese Patent Application Laid-Open No. 2014-178505 discusses an image forming apparatus including a steering unit has been discussed. In the image forming apparatus discussed in Japanese Patent Application Laid-Open No. 2014-178505, the steering unit autonomously swings according to the balance of a friction force generated between one of tension rollers called steering rollers and the belt to correct "belt deviation".

Further, a cleaning unit is provided to the image forming apparatus to remove attached materials, such as toner and paper dust, remaining on the belt after the transfer. The cleaning unit is supported by the steering unit such that the cleaning unit and the steering unit are integrally swingable, as in the apparatus discussed in Japanese Patent Application Laid-Open No. 2014-178505. In this case, the cleaning unit is supported by a support mechanism provided to the apparatus body to reduce the force applied by the gravity to a steering shaft, frame, etc. of the steering unit.

In the cleaning unit, a cleaning blade (hereinafter, simply referred to as "blade") rubs the belt across the width direction to remove attached materials remaining on the belt, so the blade and the belt are abraded due to use over time, environmental changes, etc. As the abrasion is developed, the friction force between the blade and the belt increases, and this can cause the blade to vibrate. If the blade vibrates, a fixing sheet metal holding the blade across the width direction transmits the vibration of the blade to the body of the cleaning unit (hereinafter, referred to as "unit body"), such as a storage container, and this can cause the unit body to vibrate. If the unit body vibrates, a loud vibration sound is produced, and cleaning defects are likely to occur. Japanese Patent Application Laid-Open No. 2010-20134 discusses an image forming apparatus in which the unit body is brought into contact with an elastic member so that the elastic member reduces vibrations of the unit body.

Meanwhile, in cases in which the fixing sheet metal is supported at both end portions in the width direction by the unit body, the fixing sheet metal is likely to vibrate in proportion to the friction force between the blade and the belt with its central portion in the width direction being more deflected than the end portions are deflected (so-called "natural vibration"). However, the apparatus discussed in Japanese Patent Application Laid-Open No. 2010-20134 becomes unable to reduce vibrations of the unit body if the deflection, i.e., amplitude, of the fixing sheet metal increases. Thus, there have been demands for an apparatus capable of preventing deflections of the fixing sheet metal to reduce vibrations of the unit body, but such an apparatus has not been discussed.

SUMMARY OF THE INVENTION

The present disclosure is in view of the above-described situation and is directed to an image forming apparatus capable of preventing vibrations of a blade from being transmitted to a unit body with a simple structure.

According to an aspect of the present disclosure, an image forming apparatus includes an apparatus body, a belt unit removably coupled to the apparatus body, wherein the belt unit includes, a belt configured to bear a toner image, and a cleaning unit configured to clean the toner image remaining on the belt, wherein the cleaning unit includes, a blade configured to contact the belt, a sheet metal configured to hold the blade, and a cleaning container fixed to the sheet metal and configured to collect toner cleaned by the blade, and a supporting portion coupled to the apparatus body to support the sheet metal, wherein the supporting portion regulates displacement of the sheet metal due to rotation of the belt.

Further features of the present disclosure will become apparent from the following description of exemplary embodiments with reference to the attached drawings.

BRIEF DESCRIPTION OF THE DRAWINGS

FIG. 6A illustrates a case in which the belt width is larger than the roller width, and FIG. 6B illustrates a case in which the belt width is smaller than the roller width.

FIG. 8A is a side view, and FIG. 8B is a perspective view.

DESCRIPTION OF THE EMBODIMENTS

Figure 1:
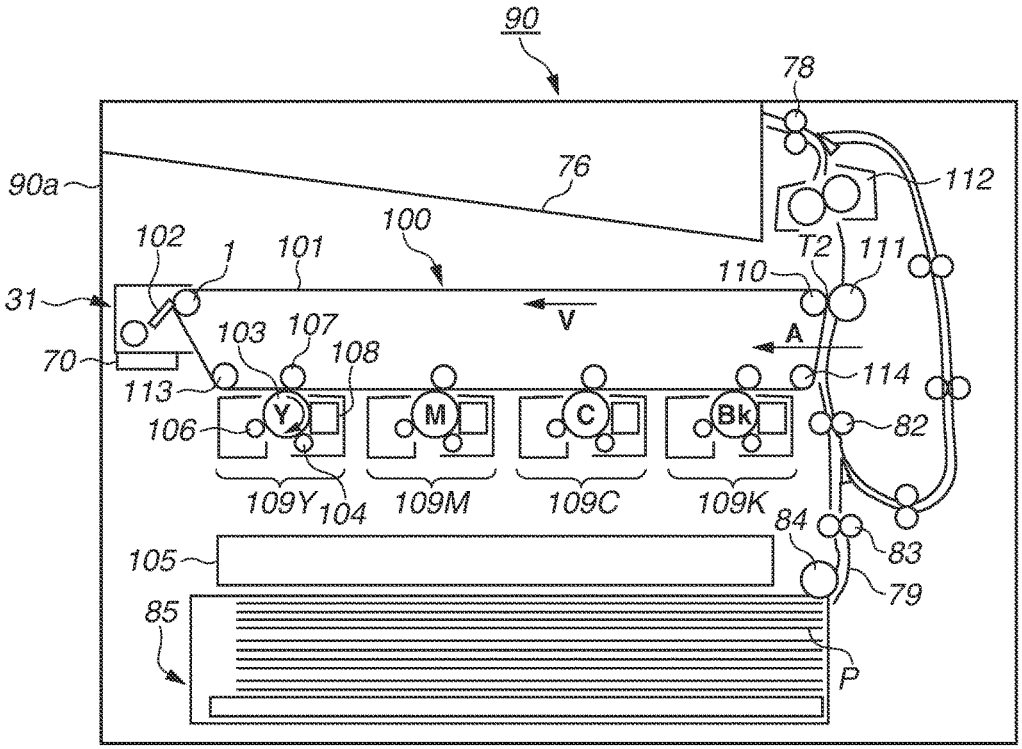
FIG. 1 schematically illustrates the structure of an image forming apparatus according to an exemplary embodiment of the present disclosure.

The structure of an image forming apparatus according to an exemplary embodiment of the present disclosure will be described below with reference to FIG. 1. In FIG. 1, an image forming apparatus 90 is an electrophotographic image forming apparatus. The image forming apparatus 90 employs an intermediate transfer tandem system in which image forming portions 109Y to 109K of four colors are aligned along the direction in which an intermediate transfer belt 101 is rotated (the direction of an arrow V in FIG. 1) in an apparatus body 90*a*.

[Image Forming Apparatus]

A process of conveying a recording material P in the image forming apparatus 90 will be described below. The recording material P (sheet, sheet material such as overhead projector (OHP) sheet, etc.) is stacked and stored in a sheet cassette 85 and is sent out to a conveyance path 79 by a sheet feeding roller 84 in synchronization with an image forming timing. The recording material P fed out from the sheet cassette 85 to the sheet feeding roller 84 is conveyed to a pair of registration rollers 83 disposed on the conveyance path 79. Then, the recording material P undergoes skew correction and timing correction performed by the pair of registration rollers 83 and is then conveyed to a secondary transfer area T2. The secondary transfer area T2 is a transfer nip area formed by an inside secondary transfer roller 110 and an outside secondary transfer roller 111 which are disposed to face each other, and a predetermined pressure and a secondary transfer voltage are applied so that a toner image is adsorbed onto the recording material P.

A process of forming an image conveyed to the secondary transfer area T2 at the same timing as the above-described process of conveying the recording material P to the secondary transfer area T2 will be described below. First, the image forming portions 109Y to 109K will be described below. First, the image forming portions 109Y to 109K will be described below. The image forming portions 109Y to 109K of the respective colors have a similar structure except that the colors of toners used in development devices are different and are yellow, magenta, cyan, and black, respectively. Thus, only the image forming portion 109Y of yellow (Y) will be described below as a representative.

In the image forming portion 109Y, a charging device 104, a development device 106, a primary transfer roller 107, and a drum cleaning device 108 are disposed to surround a photosensitive drum 103. The photosensitive drum 103 includes a photosensitive layer formed on the outer surface of an aluminum cylinder and is rotated at a predetermined processing speed. The surface of the photosensitive drum 103 which is rotated is uniformly charged in advance by the charging device 104, and thereafter an electrostatic latent image is formed on the charged surface by an exposure device 105 driven based on an image information signal. The exposure device 105 scans scanning line image data, which is obtained by developing separated color images of the respective colors, with on-off modulated laser beams using a rotation mirror and writes an electrostatic latent image of the image to the charged surface of the photosensitive drum 103.

The electrostatic latent image formed on the surface of the photosensitive drum 103 is visualized through toner development performed by the development device 106. Thereafter, the primary transfer roller 107 disposed to face the photosensitive drum 103 via a belt 101 applies a predetermined pressure and a primary transfer voltage to conduct primary transfer of the toner image formed on the photosensitive drum 103 onto the belt 101.

The processes of forming images of the respective colors which are performed in parallel by the image forming portions 109Y to 109K of yellow, magenta, cyan, and black are respectively performed at the timings of sequentially superimposing a toner image onto an upstream-color toner image borne on the belt 101. Consequently, a full-color toner image is eventually formed on the belt 101 and conveyed to the secondary transfer area T2.

By the conveyance process and the image forming process which are described above, the timings of the recording material P and the full-color toner image coincide at the secondary transfer area T2, and the secondary transfer is conducted. The recording material P having undergone the secondary transfer is conveyed to a fixing device 112, and the toner image is fused and fixed onto the recording material P with a predetermined pressure and heat quantity. The recording material P with the fixed image is discharged onto a sheet discharge tray 76 as a sheet discharge roller 78 is rotated.

The toner that remains on the photosensitive drum 103 after the primary transfer is removed by the drum cleaning device 108. On the other hand, the toner that remains on the belt 101 after being conveyed through the secondary transfer area T2, i.e., after the secondary transfer, is removed by a cleaning unit 31.

The belt 101 is an endless belt stretched by a steering unit 1 (specifically a steering roller 2 described below), the inside secondary transfer roller 110, and tension rollers 113 and 114. These are integrated together as a belt unit 100. As to the belt 101, for example, a resin belt made of a resin, such as polyvinylidene fluoride (PVDF), polyamide, polyimide, polyethylene terephthalate (PET), or polycarbonate is used.

In the present exemplary embodiment, the belt 101 is rotated as the inside secondary transfer roller 110 is driven by a motor (not illustrated), etc. provided in the apparatus body 90*a*. Specifically, the inside secondary transfer roller 110 functions as a driving roller which rotates the belt 101. Further, the steering unit 1 not only has a function as a steering mechanism for correcting "belt deviation" but also has a function of biasing the belt 101 from the inside toward the outside to apply a tension pressure to the belt 101, as described below.

Meanwhile, when the belt 101 stretched by the plurality of rollers as described above is rotated, meanderings can often occur in which the belt 101 is moved in the width direction (the direction intersecting with the belt rotation direction) of the belt 101 while being rotated. The meanderings of the belt 101 can occur due to an error in the shape, displacement of the situated position, etc. of the belt 101 or the rollers supporting the belt 101. If the belt 101 meanders, toner images of the respective colors are relatively displaced when being transferred and superimposed onto the belt 101, and this can cause image defects such as color shifts and unevenness of color. Furthermore, the belt 101 can move beyond the extent within which the belt 101 can be stretched by the rollers, causing the belt 101 to touch other parts, etc. and be damaged. Thus, in the image forming apparatus 90 of the intermediate transfer method using the belt 101, the meanderings of the belt 101 need to be prevented.

A steering method is a known technique for overcoming the meanderings of the belt 101. In the steering method, one (or two) of the plurality of tension rollers by which the belt 101 is stretched is tilted as a steering roller, and the belt 101 is moved in the width direction to prevent the belt 101 from meandering. In the present exemplary embodiment, the steering unit 1 for the foregoing purpose is integrated with the belt unit 100.

Figure 2:
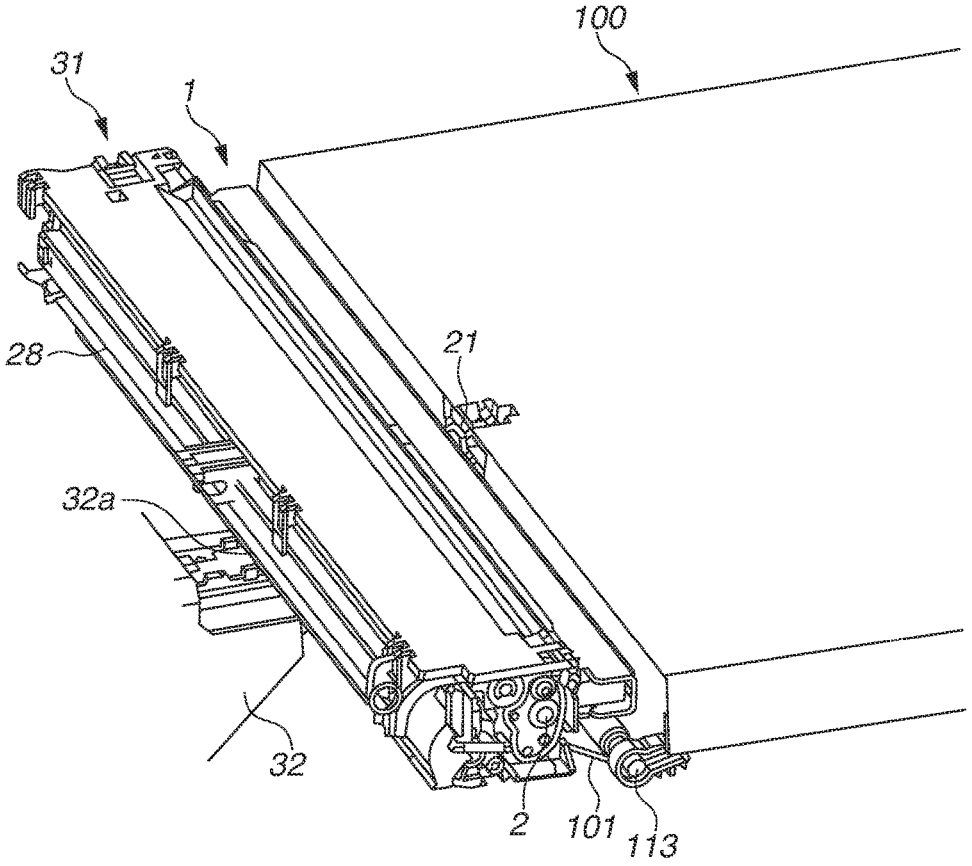
FIG. 2 is a perspective view illustrating an end side of a belt unit according to a first exemplary embodiment.

FIG. 2 illustrates the belt unit 100 according to the first exemplary embodiment. The belt unit 100 according to the present exemplary embodiment includes the steering unit 1 which is an autonomous (self-centering type) steering unit and automatically swings according to the balance of friction force generated between a slide ring member 3 (refer to FIG. 3) and the belt 101. Specifically, the steering unit 1 swings to change the steering angle (also referred to as "alignment") of the steering roller 2 as a second roller with respect to the inside secondary transfer roller 110 (refer to FIG. 1) as a first roller, and adjusts the position of the belt 101 in the width direction. The steering unit 1 is swingable in the range of, for example, plus and minus 1.5 degrees with respect to the horizontal position.

[Steering Unit]

Figure 3:
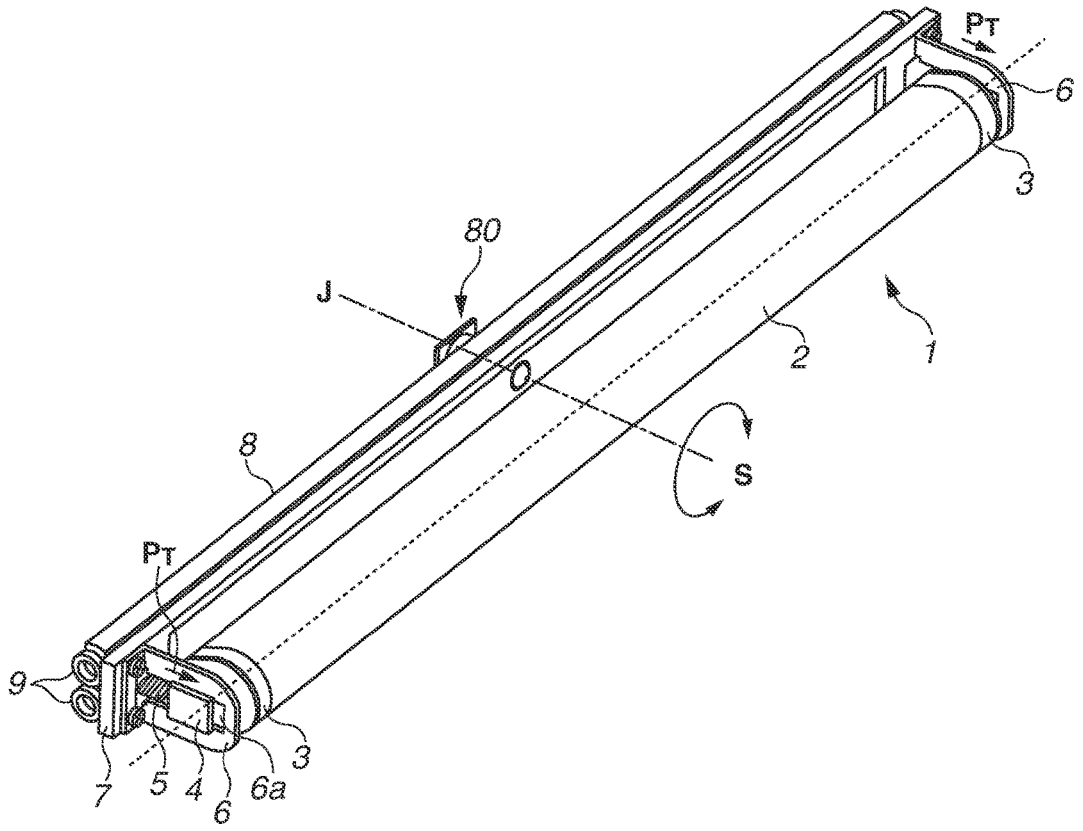
FIG. 3 is a perspective view illustrating the external view of a steering unit illustrated in FIG. 2.

The steering unit 1 will be described below with reference to FIGS. 3, 4, 5, 6A, and 6B while referring to FIGS. 1 and 2. As illustrated in FIG. 3, the steering unit 1 includes the steering roller 2 and a swing plate 7. To support the steering roller 2 such that the steering roller is freely rotatable, the swing plate 7 includes side members 6 provided to respective end portions of the swing plate 7 in the longer-side direction (the rotation shaft line direction of the steering roller 2) of the swing plate 7. The side members 6 each include a slide groove portion 6*a*.

Figure 4:
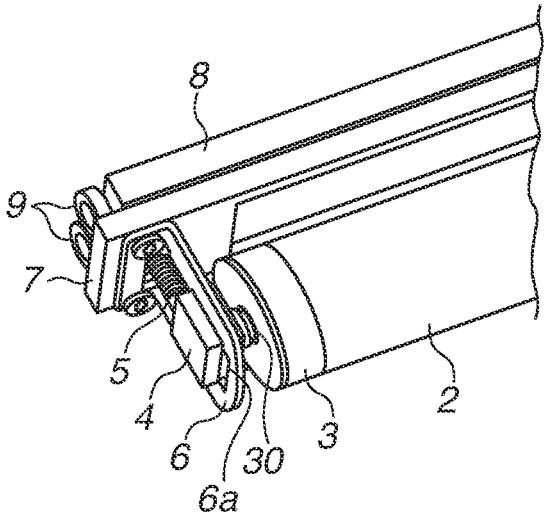
FIG. 4 is a perspective view illustrating an end side of the steering unit illustrated in FIG. 3.

As illustrated in FIG. 4, a bearing member 4 which non-rotatably supports a roller shaft 30 is slidably fitted in the slide groove portion 6*a*. The steering roller 2 is rotatably supported by the roller shaft 30. Further, the bearing member 4 is biased by a tension spring 5 (e.g., compression spring) in the direction specified by an arrow PT in FIG. 3 such that the bearing member 4 is slidable and movable along the slide groove portion 6*a*.

The slide ring member 3 is disposed at each end side of the steering roller 2 in the rotation shaft line direction. The slide ring member 3 is non-rotatably fixed to the roller shaft 30 with a parallel pin, etc. The frictional resistance of the slide ring member 3 with respect to the belt 101 is higher than that of the steering roller 2. Thus, while the steering roller 2 is driven (rotated) by the belt 101 being rotated, the slide ring member 3 is not driven by the belt 101 being rotated and can rub the belt 101 being rotated. As to the slide ring member 3, a straight-shaped slide ring member having a uniform outer diameter or a tapered slide ring member having an outer diameter which increases continuously from the center toward end portions in the rotation shaft line direction of the steering roller 2 is used.

The slide ring member 3 can rotatably be provided, as the steering roller 2 is rotatably provided. In this case, however, the torque applied to rotate the slide ring member 3 by the belt 101 is set higher than the torque applied to rotate the steering roller 2 by the belt 101 to cause a steering operation.

As illustrated in FIG. 3, the steering unit 1 is provided such that the steering unit 1 is swingable in the direction of an arrow S specified in FIG. 3 with a steering shaft line J being the center of the swing by a self-centering mechanism unit 80 with respect to a frame stay 8. The swing plate 7 is attached to the frame stay 8. The frame stay 8 is a member which serves as a part of the belt unit 100 (refer to FIG. 2) and extends between side plates of the respective ends of the belt unit 100. The swing plate 7 is swingably attached to the frame stay 8 with the steering shaft line J being the center by the self-centering mechanism unit 80 disposed in the central portion of the steering roller 2 in the rotation shaft line direction. Two slide rollers 9 are rotatably provided to each end portion of the frame stay 8 in the longer-side direction of the frame stay 8 to reduce the swing resistance of the swing plate 7 with respect to the frame stay 8.

[Self-Centering Mechanism Unit]

Figure 5:
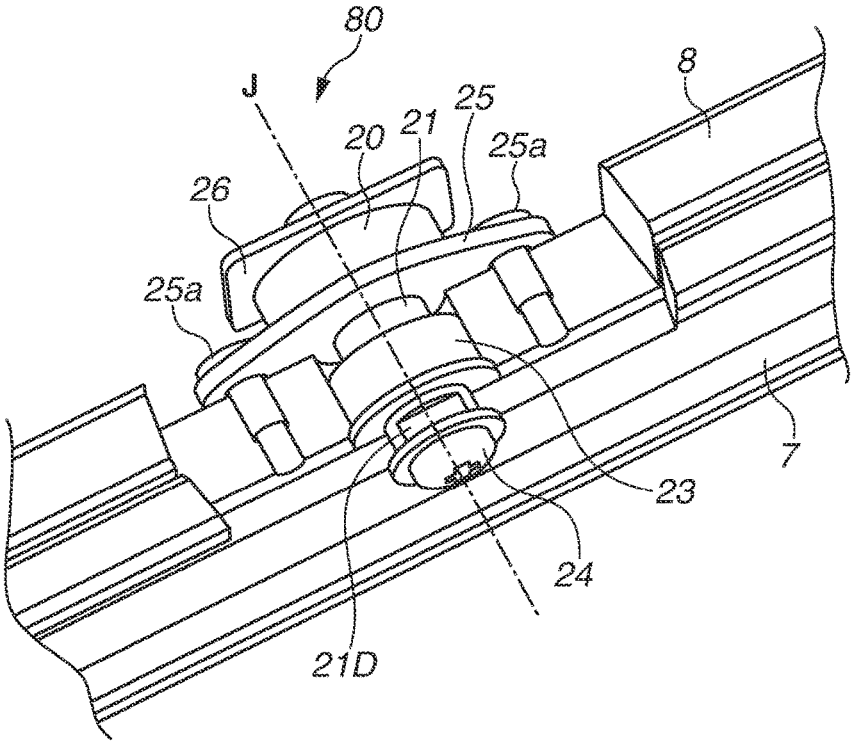
FIG. 5 is a perspective view illustrating a self-centering mechanism unit.

FIG. 5 illustrates the self-centering mechanism unit 80. As illustrated in FIG. 5, the self-centering mechanism unit 80 includes a steering shaft 21 having one end with a D-shaped key shape portion 21D. The steering shaft 21 as a swing central axis is fastened with a screw 24 with the steering shaft 21 being axially supported by a bearing 23 of the frame stay 8 and the key-shaped portion 21D being fitted in the swing plate 7.

A retaining member 26 is firmly fixed to the other end of the steering shaft 21 which is on the opposite side to the key-shaped portion 21D via a first member 20 to prevent the steering shaft 21 from escaping from the bearing 23. Further, a second member 25 is provided, on the opposite side of the first member 20, to the retaining member 26 with respect to the rotation axis line direction of the steering shaft 21. The second member 25 is fixed to the frame stay 8 with a screw 25*a* with the steering shaft 21 passing completely through the second member 25. In this way, the swing plate 7 is attached to the frame stay 8 by the self-centering mechanism unit 80. In the present exemplary embodiment, the self-centering mechanism unit 80 is located in the central portion of the steering unit 1 in the longer-side direction (the rotation shaft line direction of the steering roller 2) of the steering unit 1 (refer to FIG. 3), so the steering shaft 21 is located in the center of the steering roller 2 in the rotation shaft line direction of the steering roller 2. In cases in which the self-centering mechanism unit 80 is offset from the central portion of the steering unit 1 in the longer-side direction of the steering unit 1, the steering shaft 21 is placed in a similar offset position.

In the present exemplary embodiment, if the frictional resistance which increases or decreases according to the range of a rub of one of the slide ring members 3 and the belt 101 reaches or exceeds a predetermined value, the steering unit 1 starts swinging, i.e., a steering operation is started. Specifically, "belt deviation" can occur due to a distortion of a frame of the apparatus body 90*a*, a change in the load applied to the belt 101 while an image is being formed, etc. When "belt deviation" occurs, the frictional resistance between the slide ring member 3 and the belt 101 is high, so the steering unit 1 swings to decrease the frictional resistance so that the frictional resistance becomes smaller than a predetermined value. As a result, "belt deviation" is corrected.

Figure 6A:
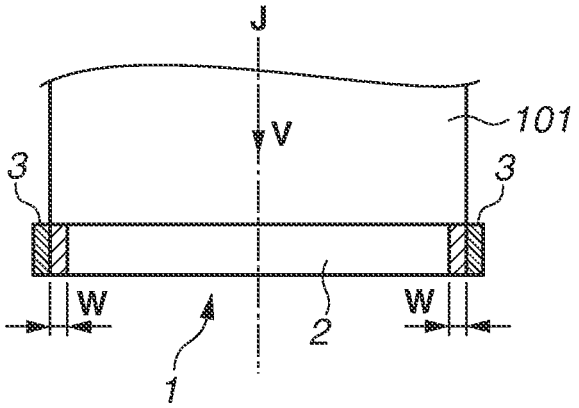
FIGS. 6A and 6B illustrate the cover width relationship between an intermediate transfer belt and a slide ring member.
Figure 6B:
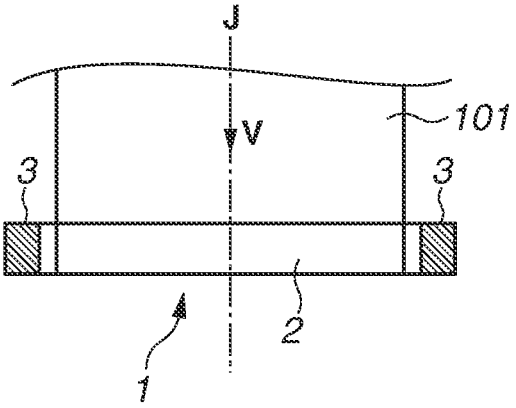

The belt width of the belt 101 is desirably larger than the roller width of the steering roller 2 and smaller than the width (roller width+width of the slide ring members 3 at the respective ends) of the steering unit 1. FIGS. 6A and 6B illustrate the cover width relationship between the belt 101 and the slide ring member 3 when the belt 101 is in an ideal steady alignment state. FIG. 6A illustrates a case in which the belt width is larger than the roller width, and FIG. 6B illustrates a case in which the belt width is smaller than the roller width. In FIGS. 6A and 6B, an arrow V indicates the rotation direction of the belt 101.

As illustrated in FIG. 6A, in the case in which the belt width is larger than the roller width, the belt 101 in the ideal steady alignment state is slid with an equal cover width W with respect to the slide ring members 3. In this case, even if a belt deviation occurs, the belt 101 is rubbed by one of the slide ring members 3. Specifically, in the case in which the belt width is larger than the roller width, the belt 101 is constantly rubbed by one or both of the slide ring members 3. Thus, if a belt deviation occurs, the frictional resistances of the belt 101 and the slide ring members 3 at the respective end portions of the belt 101 in the width direction of the belt 101 immediately become different, and a steering operation is performed based on the difference. In this case, a temporal change in the steering angle of the steering unit is less likely to be rapid, i.e., a rapid steering operation in which the movement speed of the belt 101 in the width direction is high is less likely to be conducted.

On the other hand, in the case in which the belt width is smaller than the roller width as in FIG. 6B, the belt 101 in the ideal steady alignment state is slid by neither one of the slide ring members 3. In this case, even if a belt deviation occurs, there is no difference between the frictional resistances of the belt 101 and the slide ring members 3 at the respective end portions of the belt 101 in the width direction of the belt 101 until the belt 101 is rubbed by one of the slide ring members 3. Thus, there can be a time lag until a steering operation is conducted. Further, in this case, a large difference in frictional resistance occurs rapidly compared to the case in which the belt width is larger than the roller width, so a temporal change in the steering angle of the steering unit 1 is likely to be rapid. Specifically, a rapid steering operation in which the movement speed of the belt 101 in the width direction is high is likely to be conducted. Thus, the belt width is desirably larger than the roller width.

[Cleaning Unit]

Back to FIG. 2, the belt unit 100 is provided with the cleaning unit 31 which is disposed on the opposite side to the steering unit 1 (specifically the steering roller 2) via the belt 101 such that the cleaning unit 31 and the steering unit 1 are integrally swingable. The cleaning unit 31 will be described below with reference to FIG. 7. To make the description easy to understand, the belt 101 is not illustrated in FIG. 7.

Figure 7:
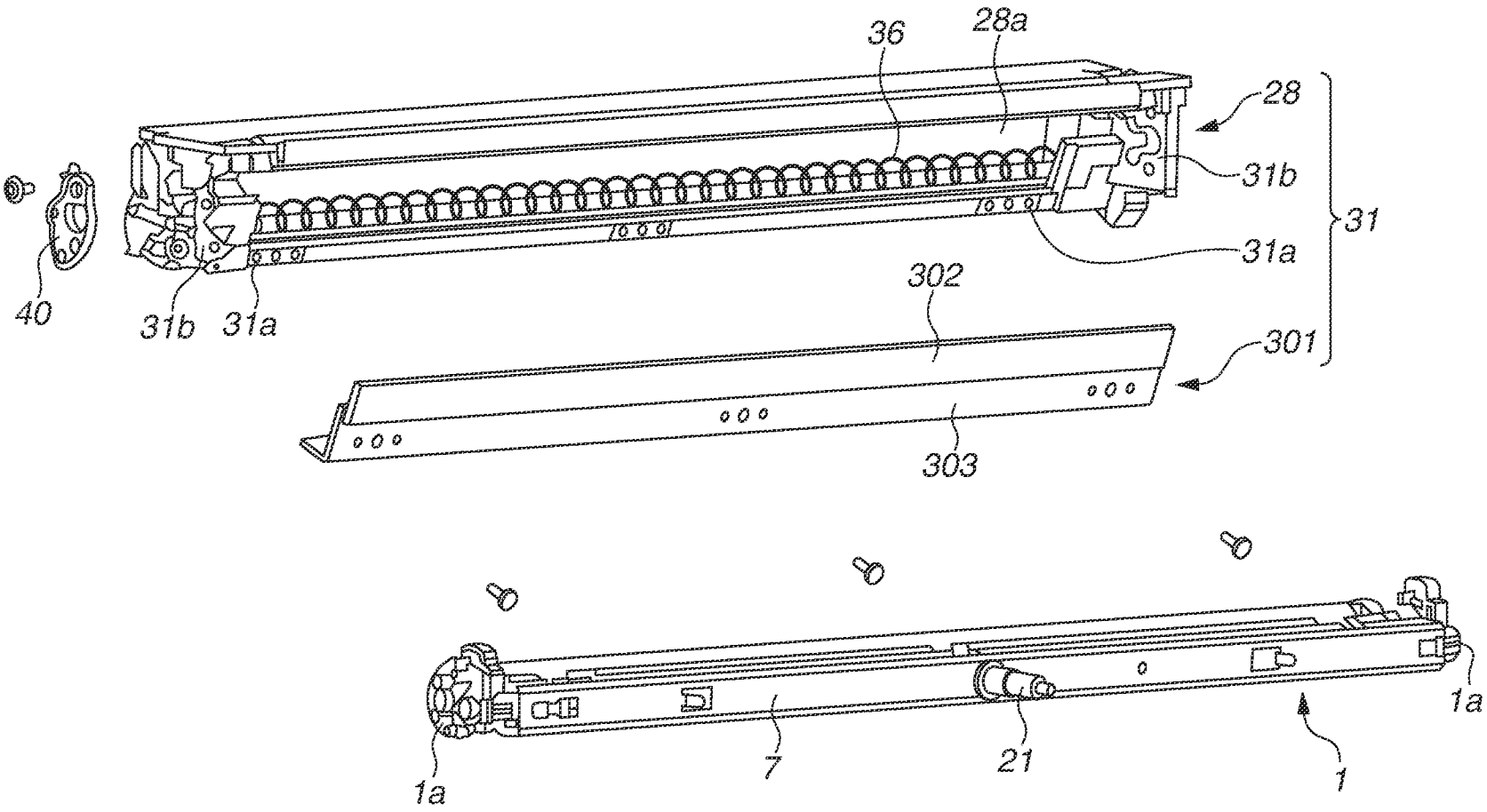
FIG. 7 is an exploded perspective view illustrating a cleaning unit and the steering unit.

As illustrated in FIG. 7, the cleaning unit 31 is divided roughly into a blade unit 301 and a storage container 28. The blade unit 301 includes a cleaning blade 302 as a blade member and a fixing sheet metal 303 as a holding member. The cleaning blade 302 is, for example, a plate-shaped rubber blade which is a rubber member made of polyurethane rubber, urethane rubber, etc. The fixing sheet metal 303 is formed by bending a plate-shaped metal member, such as stainless-steel, having a higher rigidity than the storage container 28 and the cleaning blade 302 into a substantially L-shape. The cleaning blade 302 is held by the fixing sheet metal 303 across the width direction by bonding, etc. The cleaning blade 302 is brought into contact with the belt 101 in the state in which a free end side is elastically deformed in the storage container 28.

The storage container 28 is, for example, a resin casing made of a resin and includes a storage portion 28*a* which stores toner, paper dust, etc. (hereinafter, referred to as "attached materials" for convenience) removed from the belt 101 by the cleaning blade 302. A conveyance screw 36 which conveys the attached materials is freely rotatably provided to the storage portion 28*a*. The conveyance screw is extended along the longer-side direction of the storage container 28 and conveys the attached materials from one end toward another end of the storage container 28 in the longer-side direction of the storage container 28. Further, a discharge opening (not illustrated) connected to the storage portion 28*a* is formed in the other end side of the storage container 28 in the longer-side direction of the storage container 28, and the attached materials conveyed in the storage portion 28*a* by the conveyance screw are discharged from the discharge opening into a recovery container 70 (refer to FIG. 1).

As described above, the cleaning blade 302 is fixed to the storage container 28 by the fixing sheet metal 303 such that the free end side is in contact with the belt 101. The fixing sheet metal 303 is extended in the width direction to hold the cleaning blade 302 across the width direction. Fixing portions 31*a* for fixing the fixing sheet metal 303 are formed in the respective end portions of the storage container 28, and the fixing sheet metal 303 is fixed to the fixing portions 31*a* with screws, etc. In this way, the fixing sheet metal 303 is supported on the apparatus body 90*a* at support positions in the respective end portion sides in the width direction. As described below, however, the fixing sheet metal 303 is exposed from the inside to the outside and supported on the storage container 28 at the support positions (refer to FIGS. 8A and 8B).

The cleaning unit 31 is fixed to the steering unit 1. Specifically, the steering unit 1 includes, for example, fitting members 1*a* extended from the respective end portions of the swing plate 7 in the longer-side direction toward the cleaning unit 31 facing the swing plate 7, and the fitting members 1*a* are fitted into fitted members 31*b* on the cleaning unit 31 side. With the fitting members 1*a* fitted in the fitted members 31*b*, an attachment plate 40 is attached with a screw, etc. to one of the end portion sides of the cleaning unit 31 to fix the cleaning unit 31 to the steering unit 1. In this way, even if a steering angle occurs in the steering unit 1, the contact state of the cleaning blade 302 and the belt 101 is maintained, and the attached materials on the belt 101 are removed as appropriate by the cleaning blade 302. Being fixed to the steering unit 1, the respective end portions of the storage container 28 have a higher rigidity than that of the central portion.

Figure 8A:
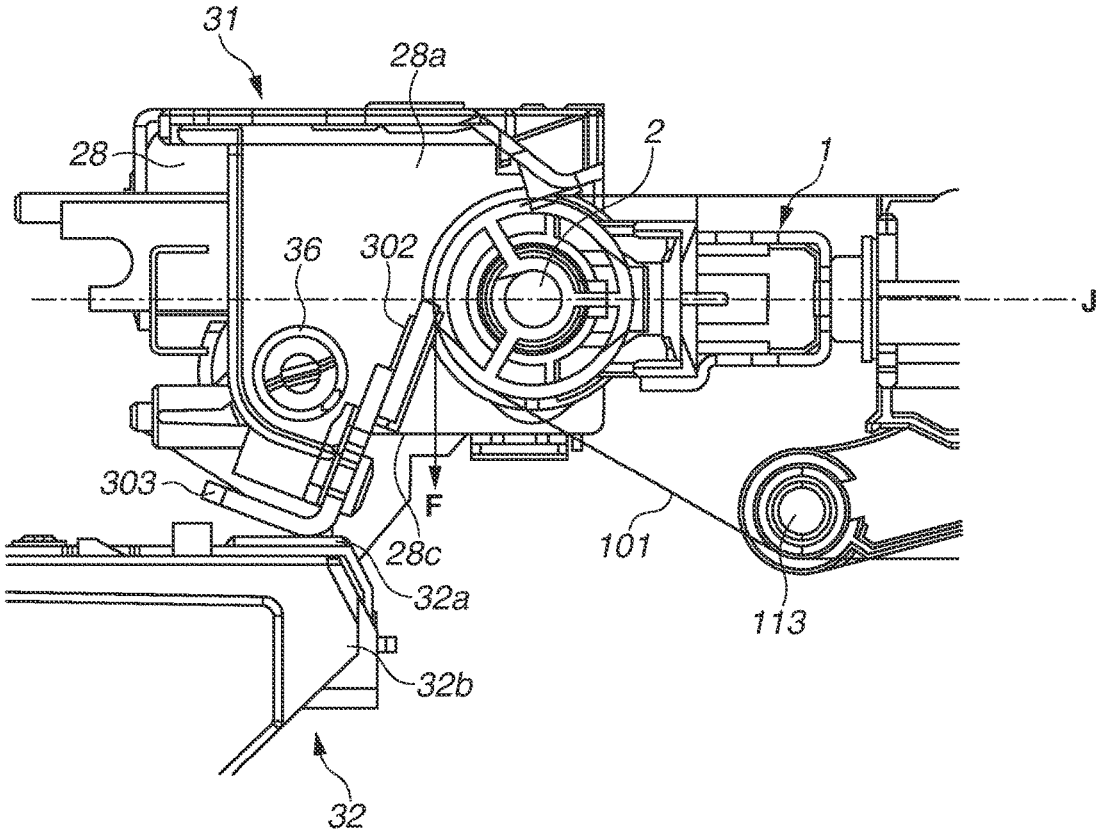
FIGS. 8A and 8B illustrate a cleaning unit support structure according to the first exemplary embodiment.

The structure for supporting the cleaning unit 31 according to the present exemplary embodiment will be described below with reference to FIGS. 8A and 8B and FIGS. 1 to 3 and 5 to 7 as needed. If the belt 101 is rotated as the image forming is started, the cleaning blade 302 slid on the belt 101 receives a friction force F in the tangential direction of the steering roller 2 facing the cleaning blade 302 via the belt 101, as illustrated in FIG. 8A. The friction force F can change significantly when, for example, the lubrication state of the belt 101 and the cleaning blade 302 is changed or when the abrasion level of the belt 101 and the cleaning blade 302 is changed. The cleaning unit 31 receives a force in the gravity direction via the cleaning blade 302 due to the friction force F, and this also affects the steering unit 1 fixing the cleaning unit 31 at the respective end portions. Specifically, the swing plate 7 (refer to FIG. 3) of the steering unit 1 can be bent in the gravity direction. In this case, a desired tension pressure is less likely to be applied to the belt 101, so image defects are more likely to occur.

Thus, the cleaning unit 31 needs to be supported from below in the gravity direction so that even if the cleaning unit 31 receives a force due to the friction force F, this does not affect the steering unit 1. In the present exemplary embodiment, a supporting portion 32 is in direct contact with the fixing sheet metal 303 without being in contact with the storage container 28 to substantially support the cleaning unit 31 via the fixing sheet metal 303.

As illustrated in FIG. 8A, the supporting portion 32 is extended toward the cleaning unit 31 in the apparatus body 90*a* (refer to FIG. 1). The supporting portion 32 is made of a member having a higher rigidity than that of the storage container 28. Further, the fixing sheet metal 303 is fixed to the storage container 28 such that a part of the fixing sheet metal 303 is exposed to the outside of the storage container 28. The supporting portion 32 is directly brought into contact with the exposed part of the fixing sheet metal 303 to support the cleaning unit 31 without coming into contact with the storage container 28.

Figure 8B:
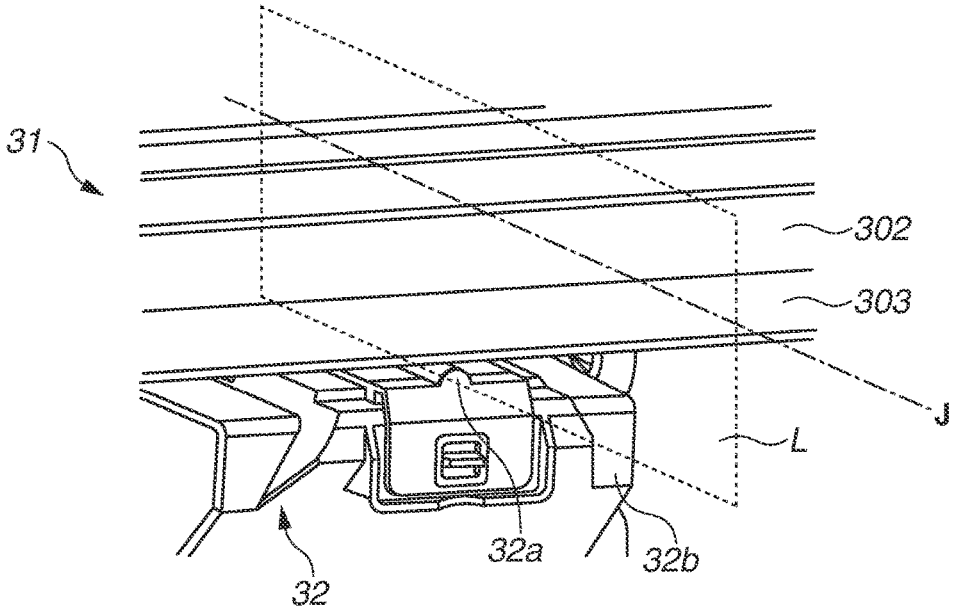

As illustrated in FIGS. 8A and 8B, the supporting portion 32 includes a protrusion portion 32*b* and a ridge portion 32*a*. The protrusion portion 32*b* protrudes toward the fixing sheet metal 303 side (holding member side), and the ridge portion 32*a* is formed parallel to the steering shaft 21 (refer to FIG. 2) on the protrusion portion 32*b* and is in contact with the fixing sheet metal 303. In the present exemplary embodiment, the ridge portion 32*a* is situated to be in contact with the fixing sheet metal 303 in a position including a vertical surface L passing through the steering shaft 21 of the steering roller 2 with respect to the rotation shaft line direction of the steering roller 2. The swing center of the steering roller is the steering shaft 21, so the vertical surface L includes the steering shaft line J. The steering shaft 21 is provided in the central portion in the rotation shaft line direction of the steering roller 2 (the width direction intersecting with the belt rotation direction), so the ridge portion 32*a* is situated to be in contact with the fixing sheet metal 303 in a position corresponding to the central portion of the steering roller 2 in the width direction of the steering roller 2. Further, an edge of the ridge portion 32*a* that is in contact with the fixing sheet metal 303 is formed to have a substantially arc-shape toward the fixing sheet metal 303, and the surface of the ridge portion 32*a* is formed by an abrasion-resistant resin member. Further, the contact width of the ridge portion 32*a* which is in contact with the fixing sheet metal 303 is desirably, for example, substantially equal to or smaller than the diameter of the steering shaft 21 (refer to FIG. 5) so that the ridge portion 32*a* does not disturb the swing of the cleaning unit 31. In this way, the supporting portion 32 is capable of supporting the cleaning unit 31 such that the cleaning unit 31 is freely swingable about the steering shaft line J.

As described above, the cleaning unit 31 is supported by the supporting portion 32 provided to the apparatus body 90*a* (specifically the frame) so that the swing load of the steering unit 1 is reduced. Specifically, the steering unit 1 is supported on the frame stay 8 by the steering shaft 21 (refer to FIG. 2). Further, the steering unit 1 supports the cleaning unit 31 (refer to FIG. 7). Therefore, if the steering shaft 21 alone supports the steering unit 1, the load applied to the steering shaft 21 increases due to the weight of the steering unit 1 and the cleaning unit 31, and operation defects are likely to occur in the steering unit 1. Thus, the cleaning unit 31 is supported by the supporting portion 32 to reduce the load applied to the steering shaft 21 so that operation defects are less likely to occur in the steering unit 1.

As described above, in the present exemplary embodiment, the supporting portion 32 is in contact with the exposed part of the fixing sheet metal 303, which is exposed to the outside of the storage container 28, to support the cleaning unit 31 without being in contact with the storage container 28. This is because the cleaning unit 31 can vibrate thereby to produce vibration sounds and cleaning defects if the cleaning unit 31 is supported via the storage container 28 as in the conventional methods as described above. This point will be described below with reference to FIGS. 12 and 13 illustrating a conventional example.

Figure 12:
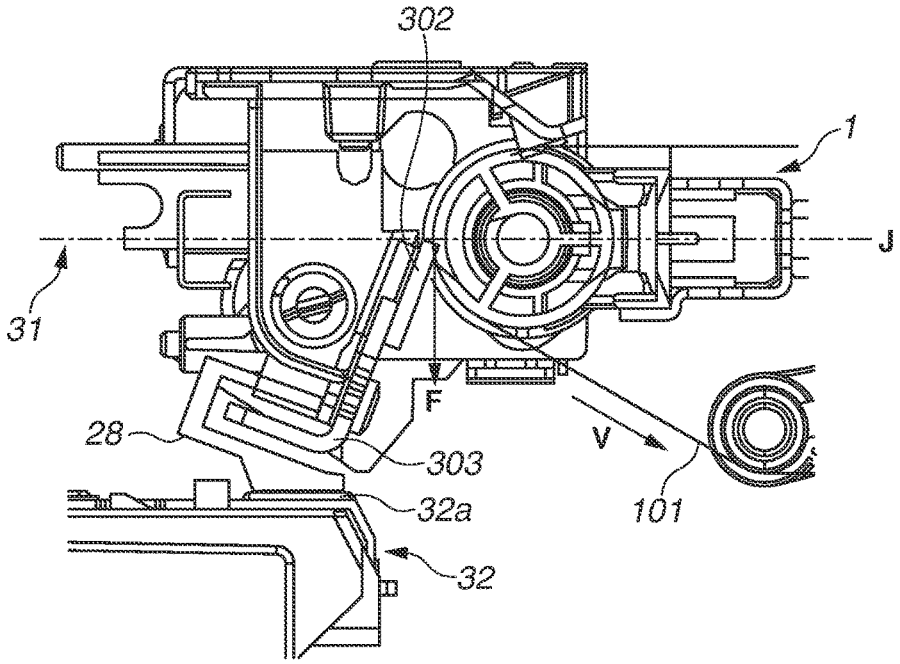
FIG. 12 illustrates a cleaning unit support structure according to a conventional example.
Figure 13:
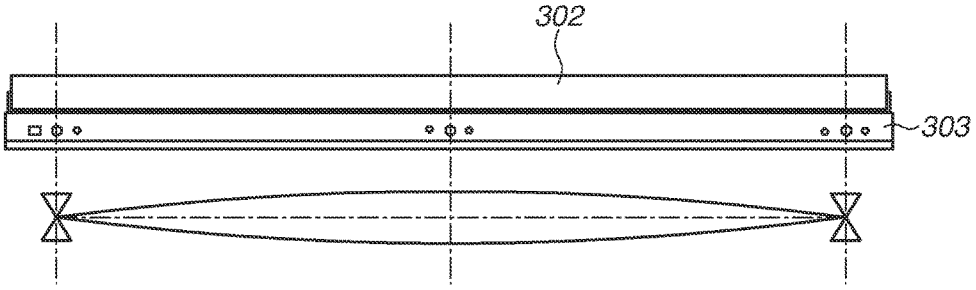
FIG. 13 illustrates a vibration of a fixing sheet metal according to the conventional example.

In the conventional example illustrated in FIG. 12, the supporting portion 32 is in contact with the storage container 28 to support the cleaning unit 31. In this case, a natural vibration of the fixing sheet metal 303 occurs in response to a vibration of the cleaning blade 302, whereby the cleaning unit 31 vibrates significantly. This is because the conventional example is not capable of preventing deflections of the fixing sheet metal 303 which cause the cleaning unit 31 to vibrate. Specifically, the fixing sheet metal 303 vibrates in proportion to the friction force F of the cleaning blade 302 and the belt 101 such that the central portion deflects more significantly than the respective end portions being fixed ends fixed to the storage container 28 (so-called "natural vibration"), as illustrated in FIG. 13. The fixing sheet metal 303 vibrates with, for example, a natural frequency of about 200 Hz. Then, the vibration is transmitted from the fixing sheet metal 303 to the storage container 28 having a lower rigidity than that of the fixing sheet metal 303 and, consequently, the cleaning unit 31 can vibrate significantly to produce vibration sounds and cleaning defects.

Two conventional methods for preventing vibrations of the fixing sheet metal 303 described above have been discussed. In the first method, the weight of the fixing sheet metal 303 is increased. In the second method, the rigidity of the fixing sheet metal 303 is increased. The first and second methods are capable of increasing the natural frequency of the fixing sheet metal 303, so the fixing sheet metal 303 is less likely to vibrate compared to the cases of lower natural vibrations at the same friction force F. However, the methods are difficult to employ because use of the methods leads to a significant increase in costs and is against the weight reduction of apparatuses.

Thus, in the present exemplary embodiment, the supporting portion 32 is brought into direct contact with not the storage container 28 but the fixing sheet metal 303 in the central portion in the width direction in which the fixing sheet metal 303 is more likely to deflect, as described above. To realize this arrangement, a part of the fixing sheet metal 303 is exposed to the outside of the storage container 28. In this way, a deformation in the direction in which the friction force F of the fixing sheet metal 303 acts is prevented compared with the conventional example, and the fixing sheet metal 303 vibrates with a higher frequency than the natural frequency in response to a vibration of the cleaning blade 302. Specifically, if the cleaning blade 302 vibrates, the fixing sheet metal 303 vibrates with the position of the contact with the ridge portion 32*a* being a fulcrum. In the present exemplary embodiment, the fixing sheet metal 303 is in contact with the ridge portion 32*a* in the central portion, so the central portion becomes a fulcrum in addition to the respective end portion sides (support positions) fixed to the storage container 28, and the fixing sheet metal 303 vibrates with a frequency which is about double the natural frequency (e.g., about 420 Hz). In this case, if the friction force F is the same, the fixing sheet metal 303 is less likely to vibrate compared to the case of vibrations with the natural frequency, and the amplitude is not increased.

As described above, in the present exemplary embodiment, the supporting portion 32 is brought into direct contact with the fixing sheet metal 303 so that deflections of the fixing sheet metal 303 which occur due to vibrations of the cleaning blade 302 are prevented with a simple structure. In this way, even if the cleaning blade 302 vibrates, the vibration of the cleaning blade 302 is less likely to be transmitted to the storage container via the fixing sheet metal 303. This produces an advantage that vibrations of the unit body which produce loud vibration sounds and cause cleaning defects are reduced.

While the belt unit 100 including the autonomous (self-centering type) steering unit 1 is described in the first exemplary embodiment, the belt unit 100 is not limited to the above-described belt unit 100. For example, the first exemplary embodiment is also applicable to a structure in which the belt unit 100 does not include the steering unit 1 and the belt movement is regulated simply with a rib, etc. The case of such a belt unit 100A will be described below with reference to FIGS. 9 to 11. Components that are similar to those of the belt unit 100 are given the same reference numerals, and description thereof is omitted.

[Tension Roller Unit]

Figure 9:
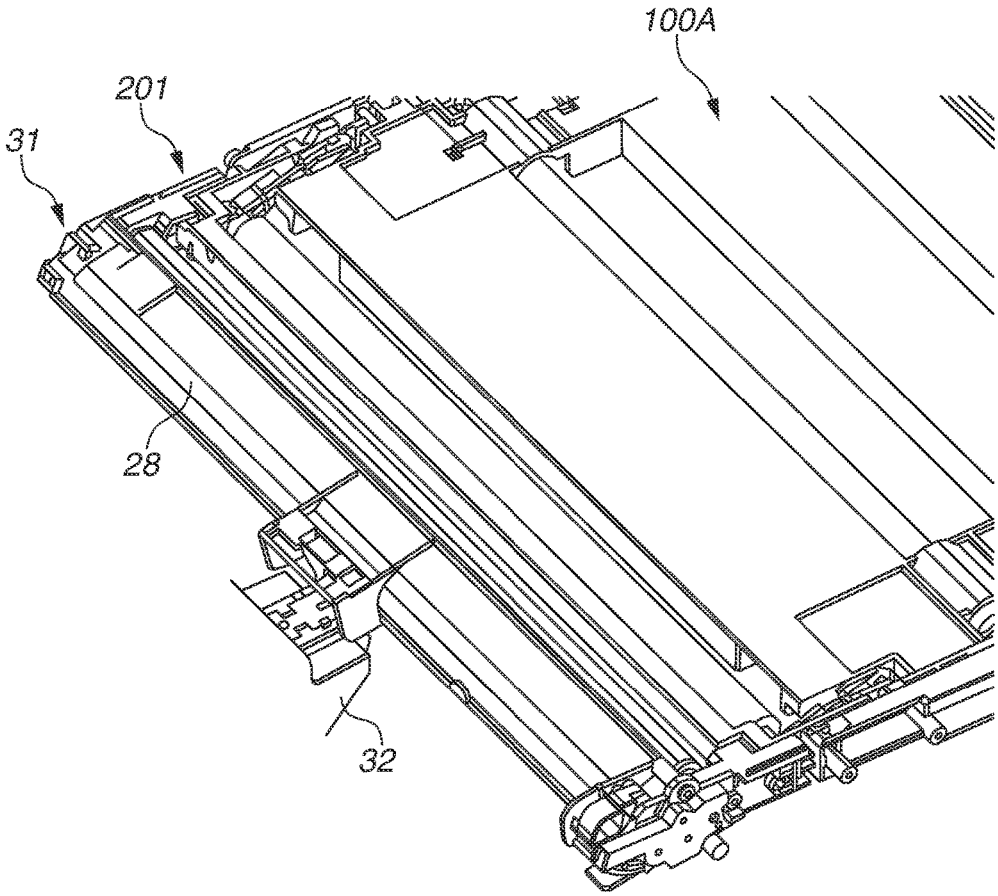
FIG. 9 is a perspective view illustrating a belt unit according to a second exemplary embodiment.
Figure 10:
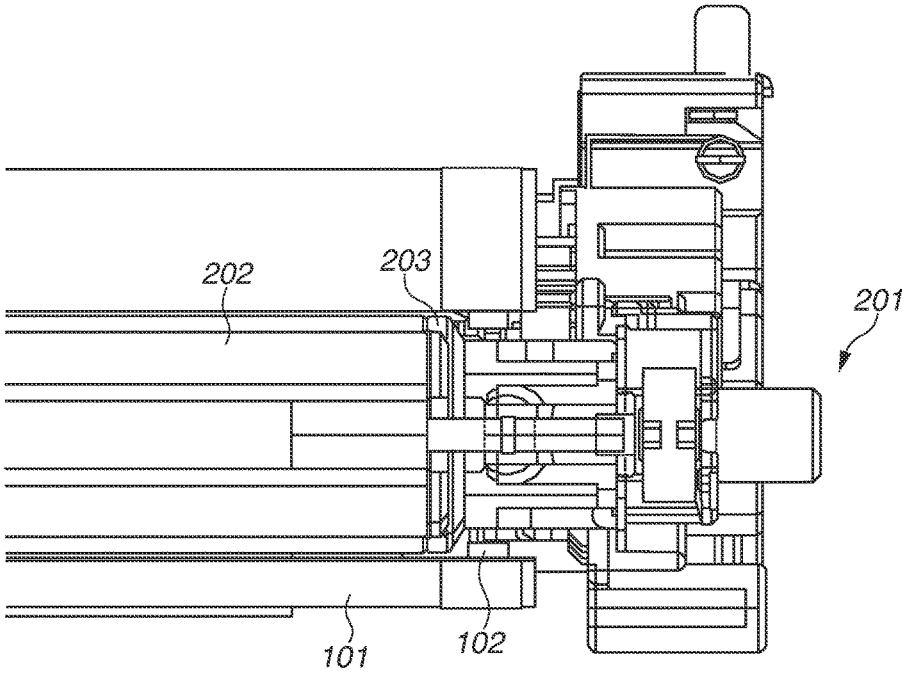
FIG. 10 schematically illustrates an end side of a tension roller unit illustrated in FIG. 9.

As illustrated in FIG. 9, the belt unit 100A according to a second exemplary embodiment includes the cleaning unit 31 and a tension roller unit 201. The tension roller unit 201 is movably provided with respect to the belt 101 (refer to FIG. 11) and biases the belt 101 from the inside toward the outside to apply a tension pressure to the belt 101. As illustrated in FIG. 10, the tension roller unit 201 includes a tension roller 202, and regulation rollers 203 are rotatably situated at respective end portions of the tension roller 202 on the same axis. Further, a rib 102 is formed on the inner surface of the belt 101. The rib 102 is formed completely around each end side of the belt 101 in the width direction of the belt 101. In the present exemplary embodiment, even if a deviation of the belt 101 occurs, the ribs 102 abut against the regulation roller 203 of the tension roller 202 so that the belt 101 moving toward one of the end portion sides in the width direction of the belt 101 can no longer move. The belt deviation is thus regulated.

[Cleaning Unit]

Figure 11:
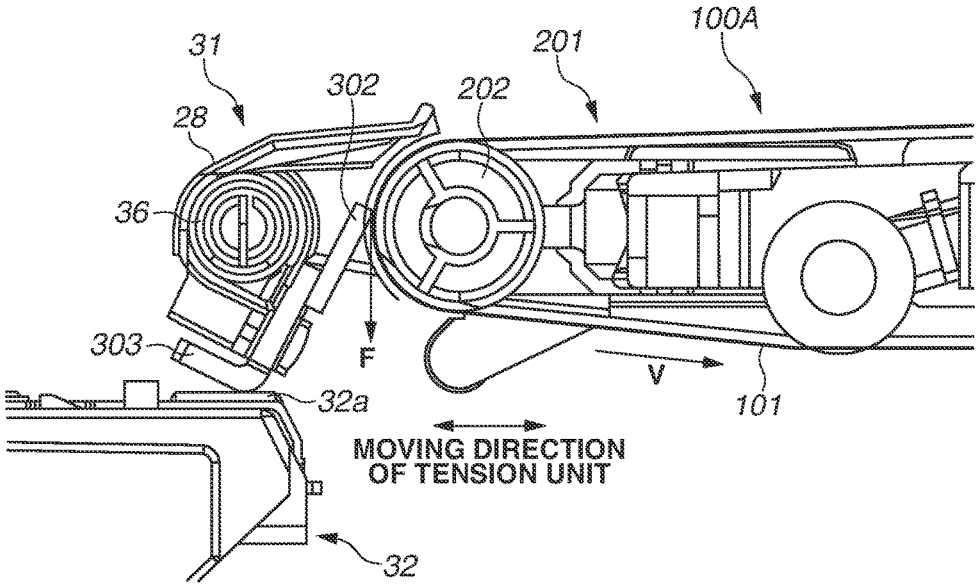
FIG. 11 illustrates a cleaning unit support structure according to the second exemplary embodiment.

The cleaning unit 31 is supported by the tension roller unit 201 such that cleaning unit 31 and the tension roller unit 201 are integrally movable. Further, as illustrated in FIGS. 9 and 11, the cleaning unit 31 is supported from below in the gravity direction by the supporting portion 32 via the fixing sheet metal 303. In the present exemplary embodiment, the fixing sheet metal 303 is supported by the storage container 28 such that a part of the fixing sheet metal 303 is exposed to the outside of the storage container 28, as in the first exemplary embodiment. Further, the supporting portion 32 is in direct contact with the fixing sheet metal 303 without being in contact with the storage container 28.

In the second exemplary embodiment, the tension roller unit 201 does not swing unlike the steering unit 1, so the supporting portion 32 can be in contact with the fixing sheet metal 303 in not only in the central portion in the width direction but also any position closer to the central portion than to the support position. The supporting portion 32, however, is desirably in contact with the fixing sheet metal 303 in a position which is at a great distance from the respective end portions and is closer to the central portion, because in the case in which the supporting portion 32 is in contact with the fixing sheet metal 303 in a position closer to the end portions, the fixing sheet metal 303 vibrates with a frequency which is not so different from the natural frequency, compared to the case in which the supporting portion 32 is in contact with the fixing sheet metal 303 in a position closer to the central portion. Further, the supporting portion 32 can be in contact with the fixing sheet metal 303 in a plurality of positions in the width direction. For example, the supporting portion 32 can support the cleaning unit 31 at two positions located at the same distance from each other and the respective end portions. In this case, a vibration occurs with the two positions, in addition to the end portions, being fulcrums, so the fixing sheet metal 303 vibrates with a higher frequency (which is three times higher than the natural frequency) than that in the case of supporting the cleaning unit 31 only at the central portion.

As described, in the second exemplary embodiment, the supporting portion 32 is brought into direct contact with the fixing sheet metal 303 so that the fixing sheet metal 303 can vibrate with a higher frequency than the natural frequency in response to a vibration of the cleaning blade 302. In this way, even if the cleaning blade 302 vibrates, the vibration of the cleaning blade 302 is less likely to be transmitted to the storage container 28 via the fixing sheet metal 303, so an advantage that vibrations of the unit body are reduced is produced which is similar to the advantage of the first exemplary embodiment described above.

While the image forming apparatus 90 of the intermediate transfer method including the primary transfer of toner images of the respective colors from the photosensitive drums 103 of the respective colors onto the intermediate transfer belt 101 followed by the secondary transfer to collectively transfer the combined toner images of the respective colors onto the recording material P is described in the above-described exemplary embodiments, the image forming apparatus 90 is not limited to the image forming apparatus described above. For example, the exemplary embodiments are also applicable to an image forming apparatus of a direct transfer method in which toner images are directly transferred from a photosensitive drum onto a recording material held and conveyed by a transfer material conveyance belt.

The exemplary embodiments of the present disclosure are capable of preventing, with a simple structure, deflections of a fixing sheet metal which are caused by vibrations of a blade member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-039561, filed Mar. 2, 2017, which is hereby incorporated by reference herein in its entirety.

What is claimed is:

1. An image forming apparatus comprising:

an apparatus body;

a belt unit configured to be detachably mountable to the apparatus body, wherein the belt unit includes, a belt configured to bear a toner image, and a cleaning unit configured to clean the toner image remaining on the belt, wherein the cleaning unit includes, a blade configured to contact the belt, a plate configured to support the blade, and a cleaning container configured to collect toner cleaned by the blade and configured to support the plate; and a backup portion, provided on the apparatus body, configured to be in contact with the plate to support the plate.

2. The image forming apparatus according to claim 1, further comprising:

a first fixing portion, provided on the cleaning container, configured to fix one end of the plate; and a second fixing portion, provided on the cleaning container, configured to fix the other end of the plate, wherein the backup portion is in contact with the plate between the first fixing portion and the second fixing portion.

3. The image forming apparatus according to claim 1, wherein the backup portion is in contact with a central portion of the plate in a longitudinal direction of the plate.

4. The image forming apparatus according to claim 1, further comprising:

a first roller configured to stretch and rotate the belt;

a second roller configured to stretch and rotate the belt together with the first roller; and a steering mechanism configured to swing the second roller about a swing central axis intersecting with a rotation axis line of the second roller with respect to the first roller to move the belt in a direction of the rotation axis line of the second roller, wherein the backup portion is in contact with the plate in a position including a vertical surface passing through the swing central axis.

5. The image forming apparatus according to claim 4, wherein the backup portion includes a protrusion portion and a ridge portion formed parallel to the swing central axis on the protrusion portion and is in contact with the plate, the protrusion portion protruding from the apparatus body toward the plate.

6. The image forming apparatus according to claim 5, wherein the ridge portion includes an edge which is in contact with the plate and the edge has an arc-shape toward the plate.

7. The image forming apparatus according to claim 1, wherein the cleaning container includes an exposure portion that exposes a portion of the plate and the backup portion contacts the plate exposed from the exposure portion.

8. The image forming apparatus according to claim 1, wherein the backup portion has a higher rigidity than a rigidity of the cleaning container.

9. The image forming apparatus according to claim 1, wherein the backup portion is in contact with the plate from below in a gravity direction.

10. The image forming apparatus according to claim 1, wherein the belt unit is configured to be extracted from a side surface of the apparatus body and the cleaning container is supported by the belt unit at a downstream side in a direction in which the belt unit is inserted.

11. An image forming apparatus comprising:

an apparatus body;

a belt unit configured to be detachably mountable to the apparatus body, wherein the belt unit includes, a belt configured to bear a toner image, and a cleaning unit configured to clean the toner image remaining on the belt, wherein the cleaning unit includes, a blade configured to contact the belt, a plate configured to support the blade, and a cleaning container configured to collect toner cleaned by the blade and configured to support the plate; and a backup portion provided on the apparatus body, wherein the cleaning container includes an exposure portion that exposes a portion of the plate and the backup portion supports the plate through the exposure portion.

12. The image forming apparatus according to claim 11, wherein the backup portion is configured to press a central portion of the plate in a longitudinal direction of the plate to support the plate through the exposure portion when the belt unit is set.

13. An image forming apparatus comprising:

an apparatus body;

a belt unit configured to be detachably mountable to the apparatus body, wherein the belt unit includes, a belt configured to bear a toner image, and a cleaning unit configured to clean the toner image remaining on the belt, wherein the cleaning unit includes, a blade configured to contact the belt, a plate member configured to support the blade, and a cleaning container configured to collect toner cleaned by the blade; wherein the plate member is fixed to the cleaning container at fixing portions provided at both ends portions of the plate member in a longitudinal direction of the plate member, and a supporting portion, provided on the apparatus body, configured to support a central portion of the plate member in the longitudinal direction in accordance with a mounting operation of the belt unit to the apparatus body.

14. The image forming apparatus according to claim 13, wherein the supporting portion is in contact with the plate member.

15. An image forming apparatus comprising:

an apparatus body;

a belt unit configured to be detachably mountable to the apparatus body, wherein the belt unit includes, a belt configured to bear a toner image, and a cleaning unit configured to clean the toner image remaining on the belt, wherein the cleaning unit includes, a blade configured to contact the belt, a plate member configured to support the blade, and a cleaning container configured to collect toner cleaned by the blade; wherein the plate member is fixed to the cleaning container at fixing portions provided at both ends portions of the plate member in a longitudinal direction of the plate member, and a supporting portion, provided on the apparatus body, configured to support the cleaning unit and apply a contact pressure for supporting the cleaning unit to a central portion of the plate member in the longitudinal direction in accordance with a mounting operation of the belt unit to the apparatus body.

16. The image forming apparatus according to claim 15, wherein the supporting portion is in contact with the plate member.

* * * * *